US009475116B2

(12) United States Patent
Burke et al.

(10) Patent No.: US 9,475,116 B2
(45) Date of Patent: Oct. 25, 2016

(54) METHODS FOR DIE CASTING METALS USING PHASE SEPARABLE FLUIDS

(75) Inventors: John Michael Burke, Kirtland, OH (US); Alan Edward Cross, Yardley, PA (US)

(73) Assignee: Houghton Technical Corp., Wilmington, DE (US)

( * ) Notice: Subject to any disclaimer, the term of this patent is extended or adjusted under 35 U.S.C. 154(b) by 443 days.

(21) Appl. No.: 14/009,125

(22) PCT Filed: Mar. 23, 2012

(86) PCT No.: PCT/US2012/030250

§ 371 (c)(1),
(2), (4) Date: Apr. 24, 2014

(87) PCT Pub. No.: WO2012/134982

PCT Pub. Date: Oct. 4, 2012

(65) Prior Publication Data

US 2014/0224444 A1 Aug. 14, 2014

Related U.S. Application Data

(60) Provisional application No. 61/468,908, filed on Mar. 29, 2011.

(51) Int. Cl.

| | |
|---|---|
| ***B22C 3/00*** | (2006.01) |
| ***B22D 17/20*** | (2006.01) |
| ***B22D 17/22*** | (2006.01) |

(52) U.S. Cl.

CPC ..... *B22D 17/2007* (2013.01); *B22C 3/00* (2013.01); *B22D 17/22* (2013.01)

(58) Field of Classification Search

CPC ..... B22D 17/20; B22C 3/00

USPC ..... 164/72, 113; 106/38.24

See application file for complete search history.

(56) References Cited

U.S. PATENT DOCUMENTS

| | | | | |
|---|---|---|---|---|
| 3,265,212 A | | 8/1966 | Bonsall | |
| 4,636,326 A | * | 1/1987 | Hernandez et al. | C09K 3/00 252/77 |
| 2003/0085077 A1 | | 5/2003 | Ihara et al. | |

FOREIGN PATENT DOCUMENTS

| | | |
|---|---|---|
| CN | 1328099 A | 12/2001 |
| CN | 101758161 A | 6/2010 |

(Continued)

OTHER PUBLICATIONS

Patent Examination Report No. 1 dated Mar. 20, 2014 and issued in corresponding Australian Patent Application No. 2012237021.

(Continued)

*Primary Examiner* — Kevin P Kerns

(74) *Attorney, Agent, or Firm* — Howson & Howson LLP

(57) ABSTRACT

Processes for die casting metals are provided, which are more energy efficient and less expensive than the current metal die casting processes. The die casting processes discussed herein utilize a water-soluble die release fluid and hydraulic equipment which uses water-insoluble hydraulic fluid. By doing so, the hydraulic fluid and die release fluid present in the waste collected from the die casting process can be collected via separation techniques. One or both of the collected hydraulic fluid and die release fluid may then be re-used in the same die casting process, another die casting process, or other processes altogether.

16 Claims, 5 Drawing Sheets

(56) References Cited

FOREIGN PATENT DOCUMENTS

| | | |
|---|---|---|
| DE | 15 94 535 | 7/1970 |
| DE | 103 05 867 | 9/2003 |
| EP | 0 941 788 | 9/1999 |
| JP | 2010-064105 | 3/2010 |

OTHER PUBLICATIONS

Notice on the First Office Action dated Dec. 3, 2014 and issued in corresponding Chinese Patent Application No. 201280015755.8.
Skoog, "The Changing Economics of Fire-Resistant Hydraulic Fluids", in Hydraulics & Pneumatics, Quaker, 2010.
"Metalworking" in Performance Chemicals, Buckman Laboratories International, 2010.
International Search Report dated Jun. 20, 2012 and issued in corresponding International Patent Application No. PCT/US2012/030250.
Machine English translation of German Patent No. 103 05 867, dated Sep. 18, 2003.
Machine English translation of Japanese Patent No. 2010-064105, dated Mar. 25, 2010.
Adams, "Canola oil-based fluid is gentle on environment", Hydraulics and Pneumatics, 52(4): 3, Apr. 1, 1999.
Zink, "When it comes fluid to performance, match characteristics to application needs,", Hydraulics and Pneumatics, 55(5):31-35, May 1, 2002.
Kaspersen, "Going green: biodegradable products for your hydraulic system", http://www.firester.net/msw_0005_going.html, May/Jun. 2000.
Communication dated Sep. 26, 2014 issued in corresponding European Patent Application No. 12763199.2.
Combined Communication and Supplementary European Search Report dated Sep. 9, 2014 issued in corresponding European Patent Application No. 12763199.2.
Second Examination Report dated Apr. 7, 2015 in corresponding Australian Patent Application No. 2012237021.
Applicant's response to the Office Action dated Jul. 22, 2015 in Australian Patent Application No. 2012237021 filed Mar. 23, 2012.
Applicant's Response to the Office Action dated Apr. 15, 2015 in Chinese Patent Application No. 201280015755.8 filed Mar. 23, 2012.
Office Action dated Aug. 14, 2015 in Chinese Patent Application No. 201280015755.8 filed Mar. 23, 2012.
English Translation of Office Action dated Aug. 14, 2015 in Chinese Patent Application No. 201280015755.8 filed Mar. 23, 2012.
Response filed Apr. 7, 2015 to the Office Action dated Sep. 26, 2014 in corresponding European Patent Application No. 12763199.2.
Response filed Apr. 15, 2015 to the Office Action dated Dec. 3, 2014 in corresponding Chinese Patent Application No. 201280015755.8.
Response filed Mar. 27, 2015 to the Office Action dated Mar. 20, 2014 in corresponding Australian Patent Application No. 2012237021.
Liquid Interface Level Measurement, Magnetrol Special Application Series, Copyright 2009 Magnetrol International.
Office Action (Communication pursuant to Art 94(3) EPC), dated Mar. 14, 2016 in corresponding European Patent Appln No. 12 763 199.2.
Office Action dated Mar. 15, 2016 in corresponding Chinese Patent Application No. 201280015755.8 (Chinese with English translation).
Applicant's Response to the Office Action in corresponding Chinese Patent Application No. 201280015755.8 (original Chinese with English translation of instructions), dated Feb. 25, 2016.
Notice of Allowance and Grant in corresponding Australian Patent Application No. 2012237021, dated Nov. 26, 2015.
Response dated Jul. 25, 2016 in corresponding European Patent Application No. EP12763199.2, filed Mar. 23, 2012.

* cited by examiner

METHODS FOR DIE CASTING METALS USING PHASE SEPARABLE FLUIDS

BACKGROUND

Die casting has been performed industrially for decades to produce high quality metal and metal alloy pieces that range from simple to complex in design at very at rapid rates. One industry relying on die casting as a significant portion of their manufacturing plants is the automotive industry. The metal pieces, i.e., wheels and engine blocks, produced therefrom are high quality, i.e., are dimensionally accurate with a very small margin of error and smooth. In order to produce the cast metal at high rates, hydraulic systems are utilized to inject the molten metal into the die chamber and to eject the cast metal from the die. Hydraulic fluids are not only the power source of the hydraulic system, but they have other functions in the system such as aiding in heat transfer, as a sealing agent, lubricant, among others. Typically, a die release fluid is sprayed onto the die to ensure that the cast metal is easily ejected from the die, i.e., molten metal does not stick to the die, and to ensure that the die cools between castings.

Unfortunately, die casting is not a closed process. Not only does hydraulic fluid leak from the hydraulic systems, but it is difficult to control the spray of die release fluid. It is not uncommon during operation for the die release fluid to coat the outside of the equipment and run down the equipment. Were it not for catch basins typically located beneath the casting equipment, the hydraulic fluid and die release fluid would pool on the ground, seep into the ground, or flow into ground drains.

Not only is this casting system messy and inefficient, i.e., both hydraulic fluid and die release fluid are wasted, but die casting is very expensive to perform due to the costs of the equipment, e.g., casting equipment, including the hydraulic portions, and dies. Adding to the high costs associated with die casting metals is the treatment and disposal of the waste generated during the casting process.

Due to the large amount of hydraulic fluid and die release fluid collected in the catch basins, others have attempted to separate water-soluble hydraulic fluid and water-soluble die release fluid for possible reuse or waste disposal using techniques such as membrane fluid separations. However, these attempts have failed, resulting in waste treatment of the hydraulic fluid and die release fluid. Treatment typically entails mixing the waste with water, thereby generating up to 100,000 gallons of waste water per day.

Although the industry recognized the significant expenses required for disposal of this amount of waste water, the industry has to date demonstrated no methods for altering the die casting process or reagent, reducing the amount of waste or more inexpensively disposing of the waste generated from die casting processes.

SUMMARY OF THE INVENTION

Novel processes for die casting metals and metal alloys, which are less expensive than the current die casting processes, i.e., by generating considerable less waste, are disclosed herein.

In one aspect, a process for die casting a metal or metal alloy is provided and includes die casting the metal or metal alloy using a die coated with a water-soluble die release fluid and hydraulic equipment containing water-insoluble hydraulic fluid. In one embodiment, the die release fluid and the hydraulic fluid are immiscible. In another embodiment, the metal is, or metal alloy contains, aluminum.

In another aspect, a process for recycling chemicals utilized for die casting a metal or metal alloy, e.g., such as a metal or alloy containing aluminum, is provided. The process includes (i) applying a water-soluble die release fluid to a die in a die casting machine, (ii) die casting the metal or metal alloy using hydraulic equipment containing a water-insoluble hydraulic fluid, (iii) collecting the used die release fluid and used hydraulic fluid from a catch basin, and (iv) isolating the used die release fluid and used hydraulic fluid. In one embodiment, the die release fluid and hydraulic fluid are immiscible.

In a further aspect, a process for recycling used die release fluid from die casting a metal or metal alloy, e.g., such as a metal or alloy containing aluminum, is provided. This process includes (i) applying a water-soluble die release fluid to a die in a die casting machine, (ii) die casting the metal or metal alloy using hydraulic equipment containing a water-insoluble hydraulic fluid which is immiscible with the die release fluid, (iii) collecting the used die release fluid and used hydraulic fluid, (iv) separating the used die release fluid and used hydraulic fluid, and (v) die casting a second sample of the metal or metal alloy using the separated, used die release fluid.

In still another aspect, a process is provided for reducing water consumption in a process of die casting a metal, e.g., such as a metal or alloy containing aluminum. This process includes (i) applying a water-soluble die release fluid to a die in a die casting machine, (ii) die casting the metal using hydraulic equipment containing a water-insoluble hydraulic fluid which is immiscible with the die release fluid, (iii) collecting the used die release fluid and used hydraulic fluid in a catch basin, (iv) separating the used die release fluid and used hydraulic fluid, (v) die casting a second sample of the metal with the separated, used die release fluid, and (vi) rectifying the used hydraulic fluid with water or disposing of the product of step (v). In one embodiment, the amount of water in step (vi) is 10-fold less than the amount of water utilized to treat waste generated from a process for die casting a metal containing using a water-insoluble die release fluid.

In a further aspect, a system is provided for die casting a metal containing aluminum. The system includes a machine for die casting the metal. The machine includes a die coated with a water-soluble die release fluid and the machine includes hydraulic equipment utilizing a water-insoluble hydraulic fluid, wherein the die release fluid and hydraulic fluid are immiscible. The system also includes a catch basin attached to the machine via a first conduit, a filter connected to the catch basin via a second conduit, and a holding tank connected to the filter via a third conduit and to the machine via a fourth conduit. Finally, a waste tank is connected to the holding tank via a fifth conduit. In this system the water-soluble die release fluid and water-insoluble hydraulic fluid from the die cast machine separate into two phases in the holding tank. Further, the water-soluble die release fluid is returned to the die cast machine through the fourth conduit. In one embodiment, the system also includes a ninth conduit which connects the waste tank to the filter. In another embodiment, the system optionally includes two or more waste tanks connected to the ninth conduit. In a further embodiment, the system optionally includes a water tank connected to the holding tank via a sixth conduit. In still another embodiment, the system includes a die release fluid tank connected to the holding tank via a tenth conduit. In yet a further embodiment, the system includes two or more die cast machines connected to the first conduit. In another embodiment, the system includes two or more holding tanks connected to the fourth conduit. In still a further embodiment, the system includes a hydraulic fluid treatment tank connected to the holding tank via an eleventh conduit. In yet another embodiment, the system includes a pump along or preceding the second conduit. In still another embodiment, the system includes a pump along or preceding the fourth conduit.

In still another aspect, a metal die casting composition is provided and contains a water-soluble die release fluid and a water-insoluble hydraulic fluid which is immiscible with the die release fluid.

In yet a further aspect, a product is provided and contains a first container which includes a water-soluble die release fluid, a second container which includes a water-insoluble hydraulic fluid, and (iii) instructions for die casting a metal or metal alloy substrate using the first and second containers.

Other aspects and advantages of the invention will be readily apparent from the following detailed description of the invention.

DETAILED DESCRIPTION OF THE FIGURES

DETAILED DESCRIPTION OF THE INVENTION

Figure 1:
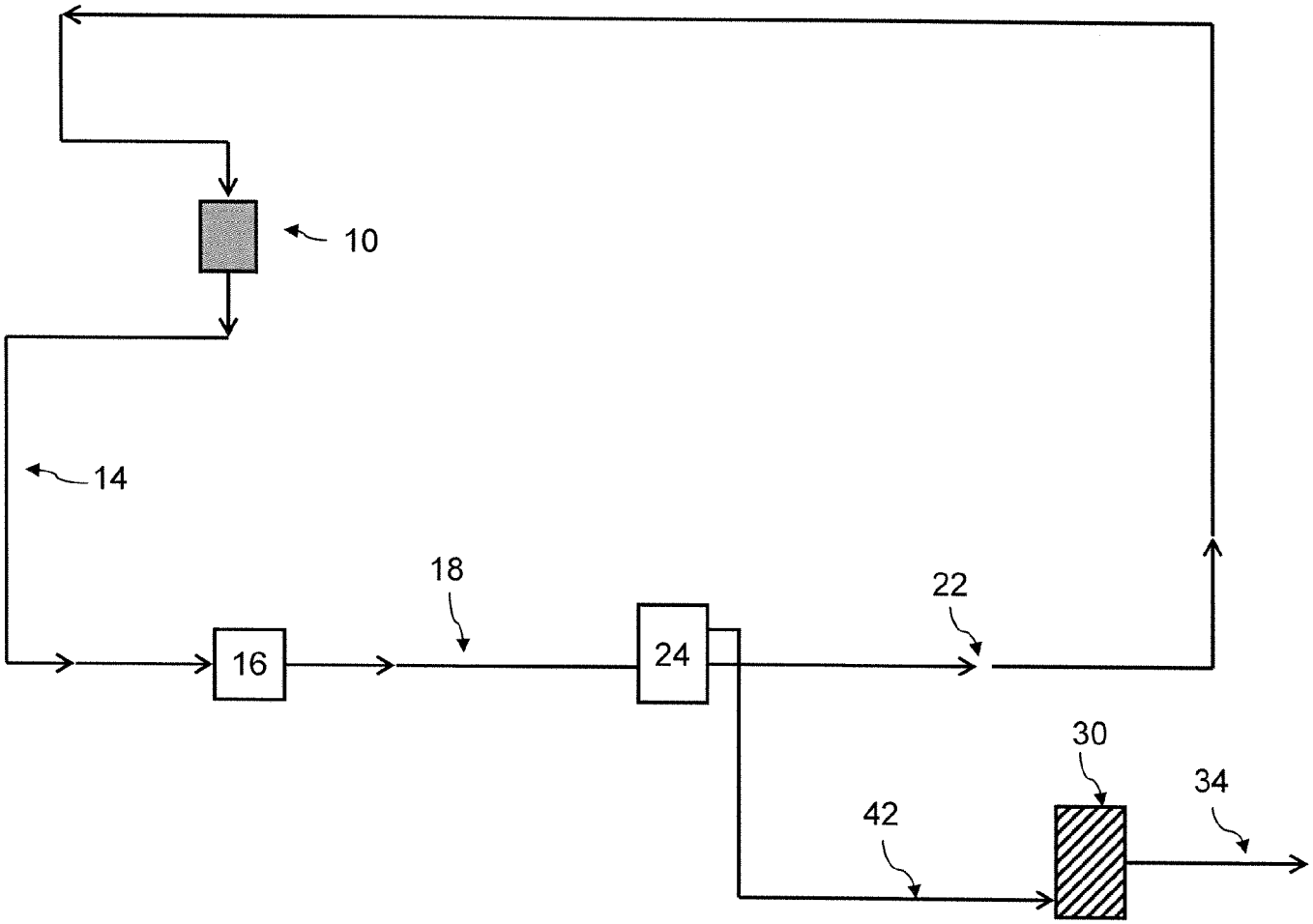
FIG. 1 is a schematic view of a basic process line for die casting a metal using a die coated with a water-soluble die release fluid and hydraulic equipment containing water-insoluble hydraulic fluid of the present invention.

In addressing the need in the art for less expensive processes for die casting metals and metal alloys, the inventors discovered a process that would unexpectedly reduce the large amounts of waste generated in die casting processes by enabling multiple recyclings of a water soluble die casting fluid through the die casting process. The novel process described herein involves using a water-insoluble hydraulic fluid in place of the more common water-soluble hydraulic fluids employed in the die casting process. Due to this modification, the used hydraulic fluid and used die release fluid are easily separated from the catch basin normally used in the die casting process for collection and retention of waste fluids. In one embodiment, the catch basin contains a composition resulting from metal or metal alloy die casting process. In another embodiment, the catch basin contains a water-soluble die release fluid and a water-insoluble hydraulic fluid, wherein the die release fluid and hydraulic fluid are easily separated. The composition in the catch basin can optionally contain an antimicrobial reagent or any of the optional reagents which are included in conventional hydraulic fluids or die release fluids.

The phrase "easily separated" is utilized herein to describe the separation of the hydraulic fluid from the die release agent. Specifically, the hydraulic fluid is "sufficiently" or "essentially" immiscible with the die release agent such that the amount of hydraulic fluid retained in the die release fluid does not compromise the properties of the re-used die release fluid. More particularly, the hydraulic fluid does not reduce the effectiveness and/or efficiency of the die release fluid for its subsequent re-use in die casting the metal or metal alloy. In one embodiment, the hydraulic fluid and die release agent do not emulsify when combined. In a further embodiment, the hydraulic fluid and die release agent do not form a rag layer when combined. In another embodiment, the hydraulic fluid and die release agent are at least 99% immiscible. In a further embodiment, the hydraulic fluid and die release agent are at least 99.1, 99.2, 99.3, 99.4, 99.5, 99.6, 99.7, 99.8, or 99.9% immiscible In yet another embodiment, the hydraulic fluid and die release fluid are 100% immiscible.

Of significance, the inventors found that the used die release fluid, which separated from the used hydraulic fluid from the catch basin, could be re-used for die casting metals. Until this discovery by the inventors, no other industry had successfully been able to recycle a die release fluid after being used in die casting a metal without compromising the quality of the die cast metal. Specifically, the inventors found that when the used die release fluid is re-used in one or more processes for die casting metals, the cast metal lacked streaking, either black or pink. Nor did the die cast metal prepared using the used die release fluid have any detrimental effects on the porosity of the cast metal, i.e., the desired low to no porosity of the cast metal was achieved. Therefore, where throughout this specification, the term "used die release fluid" is employed, it means die release fluid that has been originally employed to coat a die through a single die casting process, has been collected with hydraulic fluid as waste, and then separated from the hydraulic fluid as described herein, and recycled through multiple additional die casting cycles. In such recyclings, the used die release fluid may be supplemented with additional fresh die release fluid.

A. The Die Casting Process

The aforementioned problems in the art were solved by the novel processes described herein. Specifically, the present invention provides a process for die casting a metal or metal alloy, where the process includes die casting the metal or metal alloy using hydraulic equipment which utilizes water-insoluble hydraulic fluid. The process also includes the use of one or more dies, which is or are coated with a water-soluble die release fluid. As described above and in one embodiment, the die release fluid and the hydraulic fluid are immiscible.

(i) The Hydraulic Fluid

It is particularly important that the hydraulic fluids utilized in the processes described herein provide fire resistance. The hydraulic fluids may contain one hydraulic chemical or may be a blend of hydraulic chemicals. The term "hydraulic chemical" as used herein refers to the chemical or reagent in the hydraulic fluid which imparts the hydraulic properties to the hydraulic fluid. In one embodiment, the hydraulic fluid may contain at least 1, 2, 3, 4, or 5 hydraulic chemicals. In another embodiment, the hydraulic fluid contains at least 90% of one or more hydraulic chemicals. In a further embodiment, the hydraulic fluid contains at least 91, 92, 93, 94, 95, 96, 97, 98, 99, or 100% of hydraulic chemicals. Typically, the hydraulic fluids useful herein have an international standards organization (ISO) grade of about 32 to about 68, including smaller integers and ranges therebetween, although hydraulic fluids have ISO grades below 32 and above 68 may be utilized as determined by one skill in the art. In one embodiment, the ISO grade of the water-insoluble hydraulic fluids is about 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, 65, 66, 67, or 68.

One of skill in the art would be able to select a suitable water-insoluble hydraulic fluid for use in the present invention based on the parameters of the process and metal or metal alloy piece being cast. Although not required, it is desirable that the hydraulic fluid and the hydraulic chemical contained therein is biodegradable. In one embodiment, the hydraulic fluid contains as the hydraulic chemical(s), a natural triglyceride, which confers the benefit of a low cost, renewable, natural resource which is environmentally acceptable in contrast to conventional hydraulic fluids containing petroleum-based hydraulic chemicals. Natural triglycerides also possess greater viscosity stability at varying temperatures compared to mineral oil (petroleum-based) products. In another embodiment, the hydraulic fluid has a lower heat of combustion than conventional petroleum-based hydraulic fluids. In a further embodiment, the hydraulic fluid contains as the hydraulic chemicals one or more animal fat or vegetable oil. In still a further embodiment, the hydraulic fluid contains one or more synthetic fatty acid ester, i.e., synthetic ester. In another embodiment, the hydraulic fluid contains as a hydraulic chemical a phosphate ester. In yet another embodiment, the hydraulic fluid contains one or a blend of more than one vegetable oil, such as canola oil, corn oil, cottonseed oil, sunflower oil, peanut oil, soybean oil, coconut oil, Jojoba oil, castor oil, palm oil, and palm kernel oil. In yet another embodiment, the hydraulic fluid contains canola oil. In yet another embodiment, the hydraulic fluid contains as the hydraulic chemicals a blend of animal and vegetable oil with a synthetic fatty acid ester or polyol ester. In still a further embodiment, the hydraulic fluid is the vegetable oil based Cosmolubric® B-220 FMA reagent or the Cosmolubric® B-230 reagent. See, e.g., the hydraulic fluids described in U.S. Pat. No. 6,521,142, which is incorporated herein by reference.

Optionally, other conventional hydraulic fluid additive components may be added to the hydraulic fluid compositions discussed herein in amounts by volume of up to about 5%. Such optional components include, for example, antioxidants, corrosion inhibitors, antiwear agents, and viscosity modifiers. Antioxidants are useful additives for preventing the degradation of the hydraulic fluid through oxidation. In one embodiment, the antioxidant is present in the hydraulic fluids in the amount of about 0.5% to about 5% by weight. Such antioxidants may be selected from among an aromatic amine, quinoline, and phenolic compounds. In one embodiment, the antioxidant is an alkylated diphenyl amine (Vanlube® NA reagent, polymerized trimethyl-dihydro-quinoline (Vanlube® RD reagent) or 4,4'-methylene bis(2,6-di-tert-butylphenol).

Suitable corrosion inhibitors for both ferrous and non-ferrous metals may be selected from the battery of conventional corrosion inhibitors used in the industry. Corrosion inhibitors may be present in the hydraulic fluid discussed herein in the amount of about 0.1% to about 2% by weight. In one embodiment, the corrosion inhibitor is tolyltriazole. However, other known and commercially available corrosion inhibitors could readily be used by one of skill in the art.

Similarly, numerous antiwear agents or lubricants are known in industry. Antiwear agents are optionally present in the hydraulic fluids discussed herein in the amount of about 0% to about 2% by weight. In one embodiment, the antiwear agent is selected from among an amine phosphate which results from the reaction of mono and di-hexyl phosphate with $C_{11}$-$C_{14}$ branched alkyl amines. In another embodiment, the antiwear agent is the Irgalube® 349 reagent. One of skill in the art could readily include other suitable phosphorus and sulfur based antiwear agents.

Conventional viscosity modifiers may optionally be included in the hydraulic fluids utilized herein. Viscosity modifiers are optionally present in the hydraulic fluids in the amount to about 0% to about 10% by weight. In one embodiment, the viscosity modifier selected from among a dimer acid ester and polymerized vegetable oil. In another embodiment, the viscosity modifier is a dimer acid ester (the Priolube® 3986 reagent). Other such modifiers may be selected by one of skill in the art.

De-emulsifiers may also optionally be included in the hydraulic fluids utilized herein. This is particularly useful when high agitation rates are utilized during the process. However, their inclusion in the hydraulic fluid is not required. In one embodiment, no de-emulsifier is added to the hydraulic fluid. In another embodiment, at least one de-emulsifier is added to the hydraulic fluid. In a further embodiment, the hydraulic fluid purchased by the customer already contains a de-emulsifier. In yet another embodiment, the customer adds the de-emulsifier to the water-insoluble hydraulic fluid. One of skill in the art would be able to select a suitable de-emulsifier for use herein.

Antimicrobial agent may optionally be added to the hydraulic fluids to prevent or reduce the accumulation of microorganisms in the system. The particular antimicrobial selected will depend on the process parameters, including die release fluid, hydraulic fluid, the metal or metal alloy, the dimensions of the metal or metal alloy piece being cast, among others. One of skill in the art would be able to make such a selection. In one embodiment, the antimicrobial is the Grotan® reagent (Troy Corporation). In another embodiment, the antimicrobial may be selected from the list of microbicides discussed in the catalog "Metalworking", Buckman Laboratories, Inc., 2010, which is herein incorporated by reference in its entirety. In a further embodiment, the antimicrobial is the Busan® 1060 reagent (Buckman Laboratories).

(ii) The Die Release Fluid

The die release fluid which may utilized in the die casting processes of the present invention is a water soluble die release fluid selected by one of skill in the art considering the particular metal or metal alloy being cast, the size of the metal or metal alloy piece being case, and the size and shape, and other physical characteristics of the die being utilized. The die release fluid is inflammable at normal high temperature conditions of the die casting equipment due to its dilution with water as is known in the art. In some embodiments, the die release fluid is diluted to contain up to 95% water upon use.

The die release fluid may be an emulsion, either oil in water or water in oil, provided that the resultant emulsion is water-soluble. The die release fluid may be synthetic or partially synthetic as determined by the metal being cast. See, e.g., the die release fluids described in Andresen, Die Casting Engineering, New York (NY): Marcel Dekker, 2005, which is incorporated herein in its entirety by reference, including, particularly, pages 355-358. See, also, the water soluble die release fluids available from Cross Chemical such as the CastRite® reagents and the die release fluids available from ChemTrend such as the Safety-Lube®, Duofix®, Klubertec®, and reagents.

In one embodiment, the die release fluid is an oil in water emulsion readily selected by one of skill in the art. In another embodiment, the die release fluid contains water, surfactants, antimicrobials, petroleum oil, esters, silicones, waxes, or a combination thereof. In still a further embodiment, the die release agent contains oils, optionally containing heavy residual oil, animal fat, vegetable fat, and synthetic fats, among others. In some embodiments, the die release fluid can contain components that allow better separation from the hydraulic fluid, e.g., deemulsifiers.

It is also contemplated that additional reagents may optionally be added to the die release fluid. In one embodiment, an antimicrobial may be added to the die release fluid. In another embodiment, chemicals for control of thermal properties, such as graphite, aluminum, and mica, may be added to the die release fluid. In a further embodiment, chemical additives to inhibit rusting and oxidation may be added to the die release fluid. In still another embodiment, one or more de-emulsifiers may be added to the die-release fluid.

When an antimicrobial agent is added to the die release fluid, the particular antimicrobial selected will depend on the process parameters, including die release fluid, hydraulic fluid, metal or metal alloy being cast, among others. One of skill in the art would be able to make such a selection. In one embodiment, the antimicrobial is the Grotan® reagent (Troy Corporation). In another embodiment, the antimicrobial may be selected from the list of microbicides discussed in the catalog "Metalworking", Buckman Laboratories, Inc., 2010, which is herein incorporated by reference in its entirety. In a further embodiment, the antimicrobial is the Busan® 1060 reagent (Buckman Laboratories). The amount of the antimicrobial added in some embodiments also depends upon the size of the die casted metal or metal alloy, and the ultimate use of the die casted piece.

(iii) The Metal Die Casting Process Details

The term "metal" as used herein is meant to include any metal or metal alloy which is capable of being die cast. One of skill in the art will be able to select the metal or metal alloy based on the cast metal or cast metal alloy to be prepared. In one embodiment, the metal is a metal alloy. In a further embodiment, the metal or metal alloy contains aluminum, zinc, magnesium, copper, lead, or tin. In another embodiment, the metal or metal alloy contains aluminum. Employing the modified die casting processes and the die release fluids and hydraulic fluid combinations described herein, the resultant die cast metal is not negatively impacted, i.e., it retains its desired porosity ductility, strength such as an excellent strength-to-weight ratio, weight (either light or heavy as determined by the type of metal being die cast), corrosion resistance mechanical properties, such as good thermal electrical conductivity, high temperature resistance, hardness, wear resistance, durability, and dimensional stability, among others.

The processes of the present invention are performed using die casting equipment, i.e., die casting machines. One of skill in the art would readily be able to select suitable die casting equipment for use in die casting the selected metal. In one embodiment, the die casting equipment includes a 1500 ton die cast machine. The actual steps of die casting are known in the art as discussed in Vinarcik, "High Integrity Die Casting Processes", John Wiley & Sons, Hoboken, N.Y.: 2002 and the ASM Handbook Set, Volumes 1-24, ASM International, 2010, which are herein incorporated by reference. Simplistically, die casting is performed using die casting equipment, i.e., a die and hydraulic equipment. The hydraulic equipment utilized in metal die casting serves a variety of purposes and can readily be selected by one skilled in the art. In one embodiment, the hydraulic equipment is utilized for injecting and ejecting purposes and is operated using the water-insoluble hydraulic fluid discussed below. However, as discussed above, during operation of the hydraulic equipment, some of the hydraulic fluid leaks out of the hydraulic equipment into a catch basin.

Immediately prior to casting, a water-soluble die release agent is applied to the die using techniques known in the art. In one embodiment, the water-soluble die release agent is sprayed onto the die. See, Vinarcik and the ASM Handbook cited above, which are herein incorporated by reference, for the details known in the art regarding the die casting process, equipment and parameters, which are summarized herein. As noted above, typically some of the water-soluble die release agent drips off of the die casting equipment into the same catch basin that is utilized to catch the hydraulic fluid which leaks from the hydraulic equipment. The molten metal is then injected into the die which may be selected by those skilled in the art and as discussed in Vinarcik and the ASM Handbook cited above. In one embodiment, the molten metal is injected into the die using the aforesaid mentioned hydraulic equipment. Following injection, the molten metal is cast, typically taking seconds or as required by the metal being cast. The casting is performed using techniques known to those skilled in the art and described in Vinarcik and the ASM Handbook cited above. Following the casting period, the cast metal is ejected and collected using techniques known in the art and as described in Vinarcik and the ASM Handbook cited above. In one embodiment, the cast metal is ejected using hydraulic equipment.

According to the processes described herein, the fluids present in the catch basin are then collected. In one embodiment, the catch basin contains the die release fluid and hydraulic fluid, which are immiscible as discussed above. In another embodiment, the catch basin optionally contains extraneous materials which inadvertently fall into or are added to the catch basin. Using techniques known in the art, the fluids in the catch basin, i.e., die release fluid and hydraulic fluid, are separated. In one embodiment, the separation is a gravity separation. In another embodiment, the separation is performed using centrifugation. By doing so, the separation results in isolated hydraulic fluid, i.e., used hydraulic fluid, and isolated die release fluid, i.e., used die release fluid, which may be re-used or recycled as discussed above. In one embodiment, the isolated used die release fluid obtained by practice of the processes described herein contains less than about 5% of used hydraulic fluid. In another embodiment, the isolated used die release fluid contains less than about 5, 4.5, 4, 3.5, 3, 2.5, 2, 1.5, 1, 0.9, 0.8, 0.7, 0.6, 0.5, 0.4, 0.3, 0.2, 0.1, 0.09, 0.08, 0.07, 0.06, 0.05, 0.04, 0.03, 0.02, or 0.01% of used hydraulic fluid.

The catch basin, i.e., a sump may be located in a variety of locations in the plant. In one embodiment, the catch basin is built in to the floor of the building. In another embodiment, the catch basin is a container that is positioned directly beneath the die casting machine. In a further embodiment, the catch basin is physically located in the basement of plant and is either a container or is built into the ground. Regardless of the type of catch basin the plant utilizes, a pump is utilized to transfer the contents of the catch basin to the filter. The pump selected for this use can be determined by one skilled in the art. In one embodiment, the pump is a gear pump or centrifugal pump.

The used hydraulic fluid and/or used die release fluid obtained by practice of the disclosed processes are desirably recycled for use in another process. In one embodiment, the used die release fluid is re-used in the process from which it was recycled, i.e., to die cast another piece of the same metal. In another embodiment, the used die release fluid is re-used at least 2 more times in the process from which it was recycled, i.e., a second sample of metal is coated with the re-used die release fluid. In a further embodiment, the used die release fluid is re-used at least 2, 3, 4, 5, 6, 7, 8, 9, 10, 11, 12, 13, 14, 15, 16, 17, 18, 19, 20, 25, 30, 35, 40, 45, or 50 times in the process from which it was recycled. It is also contemplated that new, i.e., previously unused, die release fluid is combined with the used die release fluid for use in any of the above-noted processes. As is disclosed in one of the examples below, the inventors unexpectedly determined that an original die release fluid treated and separated from hydraulic fluid by the process described herein could be reused and recycled back into the die casting process at least 13 times.

The used die release fluid may also be recycled and used in other processes. In one embodiment, the used die release fluid may be re-used in another process for die casting the same metal. In a further embodiment, the used die release fluid may be re-used in another process for die casting another type of metal. In another embodiment, the used die release fluid may be re-used in a process aside from die casting metals.

Similarly, the used hydraulic fluid may be re-used. Prior to re-use, the used hydraulic fluid is desirably rectified using water. The term "rectifying" is known in the art to describe the re-working of the hydraulic fluid to its original state, i.e., to function again as a hydraulic and be used again. Rectifying also includes cleaning the hydraulic fluid for use in another application such as a component in a metal working fluid. When the used hydraulic is simply cleaned and re-used in a non-die casting process, it is not necessary to retain the original properties of the hydraulic fluid. In one embodiment, the used hydraulic fluid is re-used in the process from which it was recycled, i.e., it is utilized in the hydraulic equipment to die cast another piece of the same metal. In another embodiment, the used rectified hydraulic fluid is re-used in another process for die casting the same metal but a different die. In a further embodiment, the used rectified hydraulic fluid is re-used in a further process for die casting a different metal. In still another embodiment, the used rectified hydraulic fluid is re-used in a process aside from die-casting.

Advantageously, by recycling one or both of the die release fluid or hydraulic fluid, considerable costs are saved. In one embodiment, it will be necessary for the customer to purchase only a fraction of the die release fluid. In another embodiment, it will be necessary for the customer to purchase only a fraction of the hydraulic fluid.

Not only does this reduce the die casting costs for the customer, but considerably less waste is produced. This reduction in waste has several advantages. In one embodiment, because one or both of the die release fluid or hydraulic fluid are re-used, less water, which is the most expensive part of the waste treatment process, is required to treat the waste. This reduction of water required to treat the waste is also environmentally advantageous, i.e., water consumption is reduced for the customer. Adding to this environmental advantage is the reduction of waste which may be buried in landfills or released into public waters. In one embodiment, the amount of water utilized to treat waste generated from the processes of the present invention is at least 2-fold less than the amount of water utilized to treat waste generated from a process for die casting a metal using a water-insoluble die release fluid. In another embodiment, the amount of water utilized in the waste treatment step is at least 2-, 3-, 4-, 5-, 6-, 7-, 8-, 9-, 10-, 11-, 12-, 13-, 14-, 15-, 16-, 17-, 18-, 19, or 20-fold less than the amount of water utilized to treat waste generated from a conventional process for die casting a metal using a water-insoluble die release fluid. In some embodiments, the fold of water saved directly correlates with the number of times the original and used die release fluid is recycled through the die casting process.

Clearly, the use of a water-insoluble hydraulic fluid in the die casting processes described herein is economically beneficial. In an effort to illustrate these cost savings, the following table provides a general estimate of the costing savings incurred by a customer in die casting 720 aluminum alloy automotive parts/day using a 80:1 mix ratio of water: the Cast Rite® AMZ III die release fluid. The cost comparison below assumes recycling the fluid 10 times or a 90% reduction in new gallons used per part. In addition, the cost comparison includes the switch over from the processes using a water-soluble hydraulic fluid to a water-insoluble hydraulic fluid.

| | Prior Art Die Casting Process | Present Invention Die Casting Process |
|---|---|---|
| Hydraulic fluid | water glycol, water miscible reagent | Cosmolubric ® B220 reagent (water immiscible) |
| Cost of new fluid concentrate ($) | 10 | 10 |
| Cost of die release fluid ($/gal) | 0.13 | 0.13 |
| New gallons used/part | 1.5 | 1.5 |
| Recycled gallons/part (%) | 0 | 90 |
| Net new gallons used/part | 1.5 | 0.15 |
| Die release fluid/part ($) | 0.19 | 0.02 |
| Die release fluid ($/day) | 135.00 | 13.50 |
| Die release fluid on die (gal/day) | 1,080 | 1,080 |
| Die release fluid remaining in the system after evaporation | 1026 | 1026 |
| Waste treatment ($/gal) | 0.05 | 0.05 |
| Amount of die release fluid recycled back into process (%) | 0 | 90 |
| Amount to be disposed through waste treatment | 1,026 | 103 |
| Cost to dispose ($/day) | 51.30 | 5.13 |
| Cost of hydraulic fluid ($/gal) | 7.50 | 13.75 |
| Hydraulic fluid leakage in the system ($/gal/day) | 1.75 | 1.66 |
| Cost of hydraulic fluid ($/day) | 13.13 | 22.86 |
| Total cost ($/day) | 199.43 | 41.49 |
| cost over 250 operating days ($) | 49,856 | 10,372 |
| Pay back calculations | | |
| Annual savings per one die cast machine ($) | | 39,484 |
| Total cost to install recycle system ($) | | 12,500 |
| Return on investment (%) | | 316 |
| Return on investment (days) | | 116 |

B. Employment of the Die Casting Process

As shown, it is recognized that converting a current process utilizing water-soluble hydraulic fluids to a process utilizing water-insoluble hydraulic fluids entail costs. However, as demonstrated above, there is a huge long-term cost benefit to making this conversion.

Also provided by the present invention is a process for converting the current die casting process to the die casting process described herein which utilizes a water-insoluble hydraulic fluid. The equipment and reagents required for the same are known to those skilled in the art. Simplistically, the entire "wetting system" must be cleaned. The phrase "wetting system" includes the sections of the system which come into contact with the previous hydraulic fluid and die release fluid.

To ensure that all of the water-soluble hydraulic fluid is removed from the system, the first step of this conversion includes drainage of the existing equipment, including catch basins, hydraulic equipment, die casting machines, holding tanks, filters, pumps, conduits connecting the same, among others. Drainage can be accelerated by the use of pumps or vacuums, as determined by one skilled in the art. In one embodiment, all of the values in the wetting system are opened and the fluids collected therefrom are discarded. After closing the valves, a neutral mineral oil, or the like, is flushed through the system, the valves are opened, and the mineral oil collected therefrom is discarded. Finally, the valves are closed, the system is flushed with the water-insoluble hydraulic fluid, the valves are opened, and the water-insoluble hydraulic fluid collected is discarded. In one embodiment, the system is rinsed with the hydraulic fluid at least once prior to die casting a metal. In another embodiment, the system is rinsed with the hydraulic fluid at least 2, 3, 4, or 5 times prior to die casting a metal. Obviously, one skilled in the art will be able to determine the number of hydraulic fluid rinses as determined by types of hydraulic fluid, die release fluid, metal being cast, physical characteristics of the die being used, among others.

The hydraulic pump is then filled with the water-insoluble hydraulic fluid and the die in the die casting machine is sprayed with water-soluble die release fluid as described in Vinarcik and the ASM Handbook cited above, which are herein incorporated by reference.

C. Products for Use in the Processes

As discussed above, the die casting processes of the present invention require a water-insoluble hydraulic fluid and water-soluble die release agent. Since the hydraulic fluid and die release agent are not combined for use in the process, they are separately utilized in the processes. However, the present invention provides a metal die casting composition which contains a couple of reagents. In one embodiment, each reagent is in a separate container. These reagents include a water-soluble die release fluid and a water-insoluble hydraulic fluid. In one embodiment, the die release fluid and hydraulic fluid are immiscible.

Also envisioned by the present invention is a product including these reagents. In one embodiment, the product includes a first container which contains a water-soluble die release fluid, a second container comprising a water-insoluble hydraulic fluid which is immiscible with the die release fluid, and (iii) instructions for die casting a metal substrate using said first and second containers.

Additional containers may be further included in the product, i.e., the product may include a third or more container which contains other reagents which may optionally be added to one or both of the hydraulic fluid or die release fluid. However, the additional, if any, component(s) must not affect the function or overall performance of hydraulic fluid and die release agent. The product may also include a container which includes the reagents necessary to adapt a water-insoluble current system utilizing water-soluble hydraulic fluid to a system utilizing hydraulic fluid. When such a "switch-over" container is included in the product, the product may also include instructions for converting the customer's current system to the system described herein which utilizes a water-insoluble hydraulic fluid.

Such a product may further contain safety equipment such as disposable gloves, pumps, gases, masks, suits, glasses, decontamination instructions, and the like. However, one of skill in the art could readily assemble any number of products with the information and components necessary to perform processes of the present invention.

D. Desirable Embodiments of the Present Invention

In one embodiment, a process for recycling chemicals utilized for die casting a metal containing aluminum is provided. The process includes (i) applying a water-soluble die release fluid to a die in a die casting machine, (ii) die casting the metal using hydraulic equipment which contains a water-insoluble hydraulic fluid, (iii) collecting the used die release fluid and used hydraulic fluid from a catch basin, and (iv) isolating the used die release fluid and the used hydraulic fluid. In this process, the die release fluid and hydraulic fluid are immiscible.

In another embodiment, a process is provided for recycling used die release fluid collected from die casting a metal containing aluminum. The process includes (i) applying a water-soluble die release fluid to a die in a die casting machine, (ii) die casting the metal using hydraulic equipment containing a water-insoluble hydraulic fluid, (iii) collecting the used die release fluid and used hydraulic fluid, (iv) separating the used die release fluid and used hydraulic fluid, and (v) die casting a second sample of the metal using the used die release fluid. In this process, the die release fluid and hydraulic fluid are immiscible.

In a further embodiment, a process is provided for reducing water consumption in a process of die casting a metal containing aluminum. The process includes (i) applying a water-soluble die release fluid to a die in a die casting machine, (ii) die casting the metal using hydraulic equipment containing a water-insoluble hydraulic fluid, (iii) collecting the used die release fluid and used hydraulic fluid in a catch basin, (iv) separating the used die release fluid and used hydraulic fluid, (v) die casting a second sample of the metal with used die release fluid, and (vi) rectifying the used hydraulic fluid with water. Alternatively, step (vi) includes disposing of the product of step (v). In this process, the amount of the water in step (vi) is 10-fold less than the amount of water utilized to treat waste generated from a process for die casting a metal containing aluminum using a water-insoluble die release fluid. In still other embodiments, the amounts of water in step (vi) is 2-fold less, at least 5 fold less, at least 15-fold less or at least 20-fold less than the amount of water utilized to treat waste generated from a process for die casting a metal containing aluminum using a water-insoluble die release fluid.

E. Systems for Die Casting Metals

Also provided by the present invention are systems for die casting a metal. The system simplistically includes a die casting machine. In one embodiment, the system includes two of more die casting machines. In another embodiment, the system contains three or more die casting machines. Desirably, each machine utilizes the same hydraulic fluid and die release fluid for operation. The machine minimally includes a die which is coated with a water-soluble die release fluid. The coating is applied to the die using techniques well known in the art of die casting. In one embodiment, the coating is applied by spraying the die with a water-soluble die release fluid. The machine also includes hydraulic equipment. The hydraulic equipment utilized in such processes may also be readily selected by those in the die casting art. In one embodiment, the hydraulic equipment is operated using a water-insoluble hydraulic fluid as described above. Desirably, the die release fluid and hydraulic fluid are immiscible.

As discussed above, the catch basin may be positioned in a variety of locations, of which its purpose is to collect any hydraulic fluid which leaks out of the hydraulic equipment. The catch basin also collects any die release fluid which does not coat the die. The catch basin is attached to the die casting machine via a first conduit.

All conduits utilized in the system must be resistant to wear of the chemicals utilized in the system. In one embodiment, the conduits in the system must be resistant to corrosion, growth of bacteria, clogging, among others. Those skilled in the art of die casting would readily be able to select conduits meeting these requirements. See, i.e., the conduits described in Vinarcik and the ASM Handbook cited above, which are herein incorporated by reference.

It is also contemplated that a pump can be positioned before or along a conduit to facilitate removal of the liquids from the catch basin. As discussed above, the pump selected can be determined by one skilled in the art and may include a gear or centrifugal pump.

In an effort to ensure that any solid material which accumulates or is produced in the catch basin does not clog one or more of the conduits in the system, one or more filters is or are included in the system. In one embodiment, the filter is connected to the catch basin via a second conduit. In another embodiment, one or more filters is or are included at any point in the system to ensure free flow of the liquids of the system through the conduits. One of skill in the art would be able to select a suitable filter for use herein. In one embodiment, the filter is a screen or filter such as a coarse filter. In another embodiment, the filter is a 20μ filter. The filter size and porosity may be selected by one of skill in the art considering the physical requirements of the die casting materials and metals involved in the process.

The liquids from the catch basin are then routed to a holding tank connected to the filter via a third conduit for separation. The type and size of the holding tank may be selected and determined by one of skill in the art. See, e.g., the holding tanks described in Vinarcik and the ASM Handbook cited above, which are herein incorporated by reference. In one embodiment, 1 holding tank is included in the system. In another embodiment, 2 or more holding tanks are included in the system. In a further embodiment, 3 or more holding tanks are included in the system. In still another embodiment, 2, 3, 4, 5, 6, 7, 8, 9, 10, or more holding tanks are included in the system. Each holding tank may separately be connected to the filter via the third conduit. Alternatively, the holding tanks are connected in series through addition holding tanks. For example, the second holding tank may be connected to the first holding tank through a twelfth conduit. A third holding tank may further to connected to the first holding tank through the twelfth conduit or may be connected to the second holding tank via a thirteenth conduit. Additional holding tanks may be included in the system as determined by one of skill in the art.

Desirably, the hydraulic fluid and die release fluid undergo a phase separation in the one or more holding tanks. The separation is typically a gravity separation, although the separation may be accelerated, if necessary. In doing so, the die release fluid settles at the bottom of the holding tank and the hydraulic fluid layer is retained at the top of the holding tank. The die release fluid is removed from the holding tank via the fourth conduit. In one embodiment, the fourth conduit is connected to the bottom of the holding tank. In a further embodiment, the fourth conduit is connected to the die release machine for recycling of the die release fluid. In another embodiment, the fourth conduit is connected to a die release fluid collection tank.

Also provided by the system of the present invention is a waste tank connected to the holding tank via a fifth conduit. In one embodiment, the fifth conduit is connected to the top of the holding tank. In another embodiment, a second waste tank is connected to the first waste tank via a fourteenth conduit. One of skill in the art would readily be able to select a suitable waste tank for this use. See, e.g., the waste tanks described in Vinarcik and the ASM Handbook cited above, which are herein incorporated by reference. Additional waste tanks may be connected to the first or second waste tanks. Again, a phase separation occurs in the one or more waste tanks. The separation is typically a gravity separation, although the separation may be accelerated using centrifugation. The die release fluid settles at the bottom of the waste tank and the hydraulic fluid layer is retained at the top of the waste tank. The waste tank may be connected to a hydraulic fluid treatment tank via an eleventh conduit to facilitate this transfer. Optionally, any die release fluid in the waste tank is removed via a ninth conduit which is optionally connected to the filter. By doing so, all of the possible die release agent may be collected.

Also contemplated is the use of a pump to transfer the contents of the last holding tank utilized for the separation back to the die cast machine. Desirably, the pump is located along the fourth conduit or in front of the fourth conduit. The pump selected for this use can be determined by one skilled in the art. See, e.g., the pumps described in Vinarcik and the ASM Handbook cited above, which are herein incorporated by reference. In one embodiment, the pump is a gear pump or centrifugal pump.

Any solid material collected in the filter is then transferred to a solid waste tank. In one embodiment, this is performed manually. In another embodiment, the solid is dumped out of the filter via automation.

Additional tanks or conduits may optionally be attached to the system as needed and determined by those skilled in the art. For example, a water tank may be connected to the holding tank via a sixth conduit. By doing so, the water tank permits retaining the die release fluid:water ratio required to perform the process. One of skill in the art would be able to select a suitable waste tank for this purpose. See, e.g., the water tanks described in Vinarcik and the ASM Handbook cited above, which are herein incorporated by reference. In one embodiment, the water can facilitate phase separation in the holding tank. In another embodiment, the water mixes with the die release fluid for recycling in another die casting process.

Also contemplated is the inclusion of a die release fluid tank which contains pure or unused die release fluid. The die release fluid tank is connected to the holding tank via a tenth conduit. One of skill in the art would be able to select a suitable die release fluid tank. See, e.g., the die release fluid tanks described in Vinarcik and the ASM Handbook cited above, which are herein incorporated by reference.

In one aspect, a system is provided for die casting a metal containing aluminum. The system includes a machine for die casting the metal. The machine includes a die coated with a water-soluble die release fluid and the machine includes hydraulic equipment utilizing a water-insoluble hydraulic fluid, wherein the die release fluid and hydraulic fluid are immiscible. The system also includes a catch basin attached to the machine via a first conduit, a filter connected to the catch basin via a second conduit, and a holding tank connected to the filter via a third conduit and to the machine via a fourth conduit. Finally, a waste tank is connected to the holding tank via a fifth conduit. In this system the water-soluble die release fluid and water-insoluble hydraulic fluid from the die cast machine separate into two phases in the holding tank. Further, the water-soluble die release fluid is returned to the die cast machine through the fourth conduit. In one embodiment, the system also includes a ninth conduit which connects the waste tank to the filter. In another embodiment, the system optionally includes two or more waste tanks connected to the ninth conduit. In a further embodiment, the system optionally includes a water tank connected to the holding tank via a sixth conduit. In still another embodiment, the system includes a die release fluid tank connected to the holding tank via a tenth conduit. In yet a further embodiment, the system includes two or more die cast machines connected to the first conduit. In another embodiment, the system includes two or more holding tanks connected to the fourth conduit. In still a further embodiment, the system includes a hydraulic fluid treatment tank connected to the holding tank via an eleventh conduit. In yet another embodiment, the system includes a pump along or preceding the second conduit. In still another embodiment, the system includes a pump along or preceding the fourth conduit.

With reference to FIG. 1, metal is cast in die casting machine 10. Machine 10 utilizes a water-soluble die release fluid and hydraulic equipment containing a water-insoluble hydraulic fluid. After casting, used hydraulic fluid and used die release fluid are carried through conduit 14 to filter 16 where solids are entrapped. The resultant fluid is carried through conduit 18 to holding tank 24 where phase separation occurs between used hydraulic fluid and used die release fluid. After separation, used hydraulic fluid is carried through conduit 42 to waste tank 30 which is transferred to waste treatment via conduit 34. In addition, used die release fluid from holding tank 24 is returned to machine 10 via conduit 22 for die casting another metal.

Figure 2:
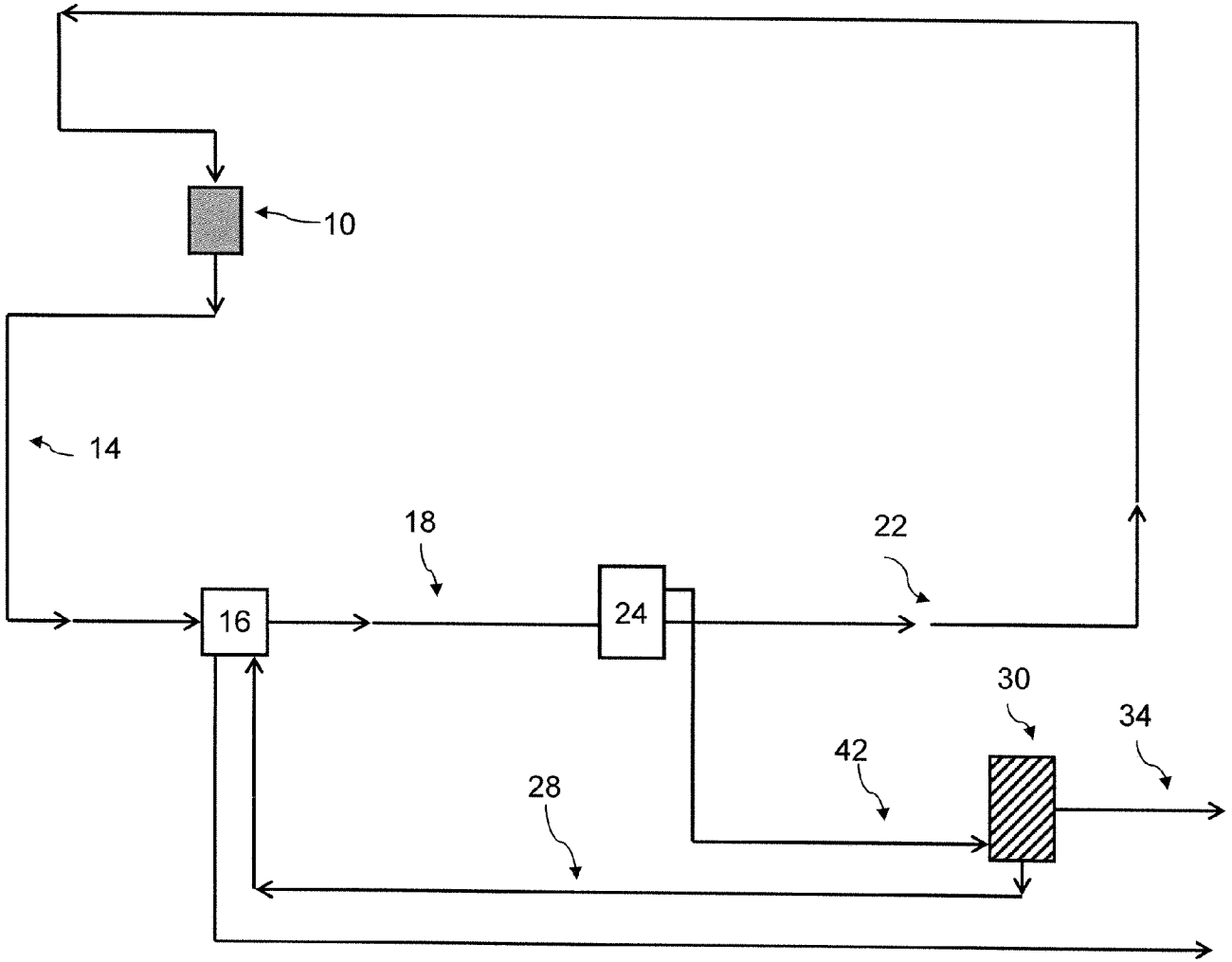
FIG. 2 is a schematic view of a process line for die casting a metal using a die coated with a water-soluble die release fluid and hydraulic equipment containing water-insoluble hydraulic fluid of the present invention. The process includes embodiments of recirculating die release fluid from a holding tank to a filter.

With reference to FIG. 2, metal is cast in die casting machine 10. Machine 10 utilizes a water-soluble die release fluid and hydraulic equipment containing a water-insoluble hydraulic fluid. After casting, used hydraulic fluid and used die release fluid is carried through conduit 14 to filter 16 where solids are entrapped. The solids which remain in filter 16 are removed manually or via automation. The resultant fluid from filter 16 is carried through conduit 18 to holding tank 24 where phase separation occurs between used hydraulic fluid and used die release fluid. After separation, used hydraulic fluid is carried through conduit 42 to waste tank 30 and used die release fluid is returned to machine 10 via conduit 22 for die casting another metal. Any remaining die release agent is separated from the hydraulic fluid in waste tank 30 and is returned to filter 16 via conduit 28. The used hydraulic fluid remaining in waste tank 30 is transferred to waste treatment via conduit 34.

Figure 3:
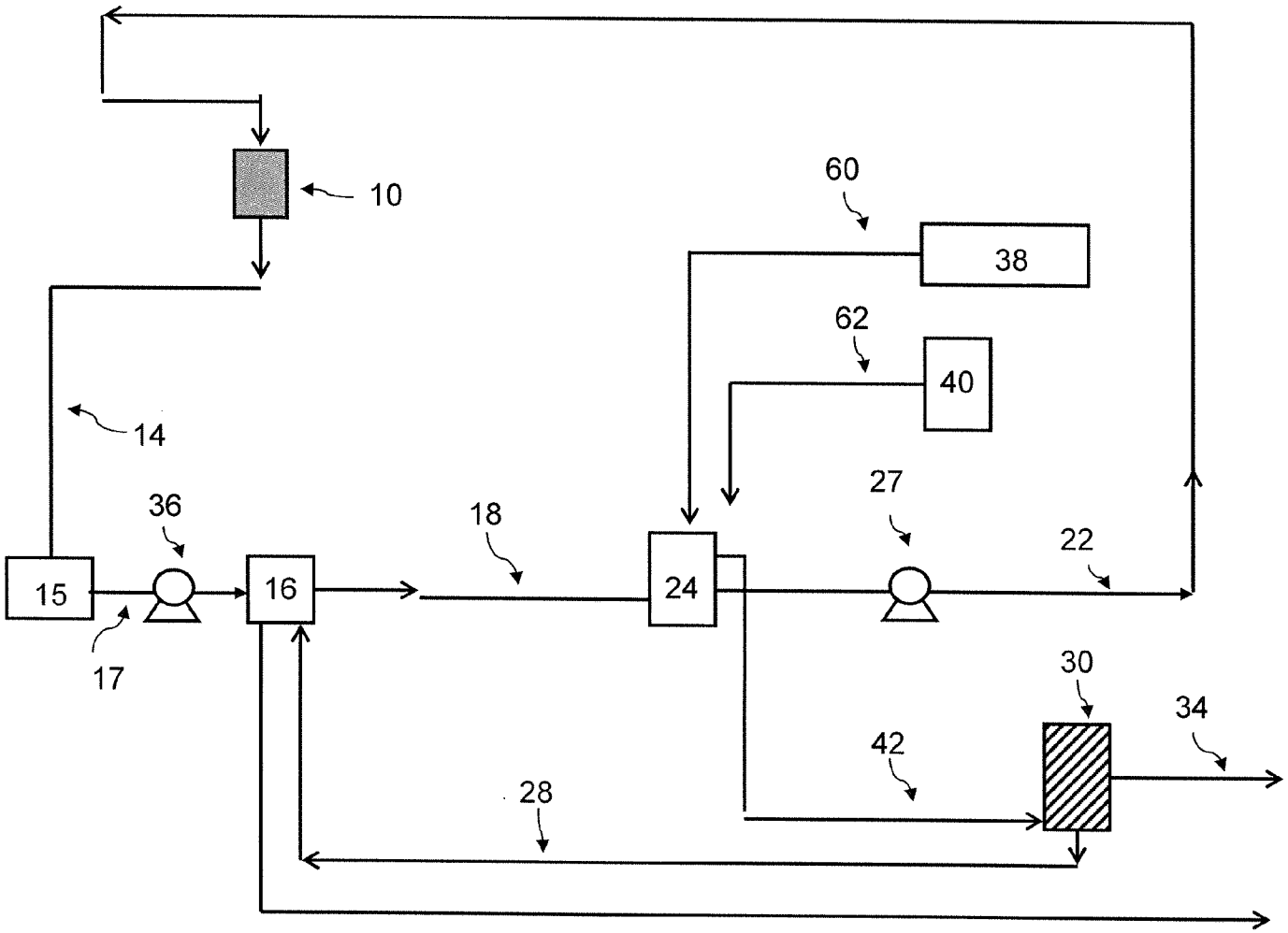
FIG. 3 is a schematic view of a process line for die casting a metal or metal alloy using a die coated with a water-soluble die release fluid and hydraulic equipment containing water-insoluble hydraulic fluid of the present invention. The process includes the additional embodiments described in FIG. 2 and additional water tanks, new die release tanks, and pumps.

With reference to FIG. 3, metal is cast in die casting machine 10. Machine 10 utilizes a water-soluble die release fluid and hydraulic equipment containing a water-insoluble hydraulic fluid. After casting, used hydraulic fluid and used die release fluid is carried through conduit 14 to catch basin 15. The fluid is thereafter transferred to filter 16 via conduit 17 through pump 36. The solids, which are entrapped in filter 16, are removed manually or via mechanical means. The resultant fluid from filter 16 is carried through conduit 18 to holding tank 24 where phase separation occurs between used hydraulic fluid and used die release fluid. After separation, used hydraulic fluid is carried through conduit 42 to waste tank 30. In addition, water from water tank 38 is added to the used die release fluid in holding tank 24 via conduit 60. New die release fluid from tank 40 is also added to holding tank 24 via conduit 62. The mixture present in holding tank 24 is then returned to machine 10 via conduit 22 for die casting another metal. A pump 27 is positioned along or preceding conduit 22 to facilitate removal of the mixture in holding tank 24. Any remaining die release agent is separated from the hydraulic fluid in waste tank 30 and is returned to filter 16 via conduit 28. The used hydraulic fluid remaining in waste tank 30 is transferred to waste treatment via conduit 34.

Figure 4:
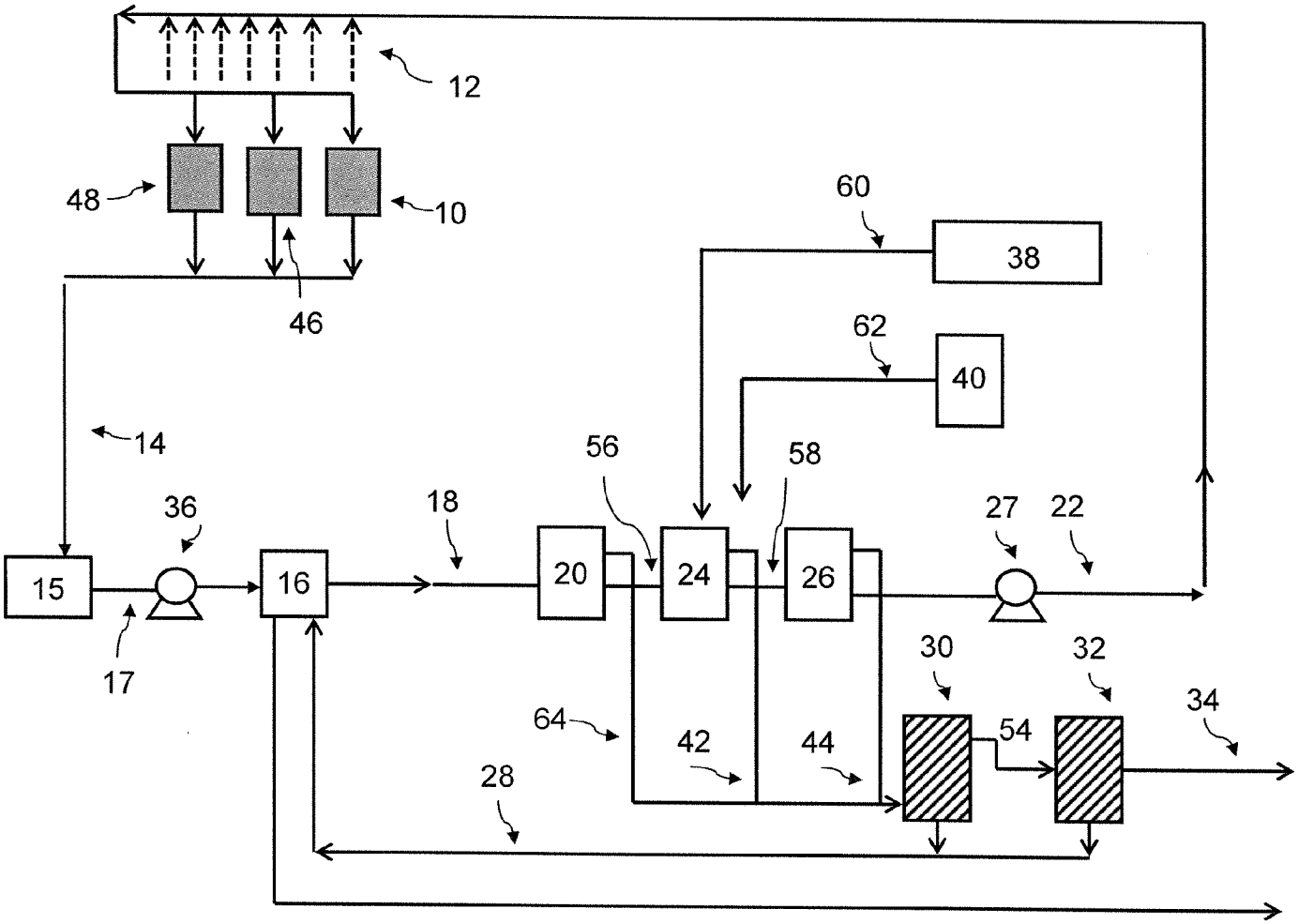
FIG. 4 is a schematic view of a process line for die casting a metal or metal alloy using a die coated with a water-soluble die release fluid and hydraulic equipment containing water-insoluble hydraulic fluid of the present invention. The process includes multiple die coating machines, holding tanks, and waste tanks.

Finally, with reference to FIG. 4, metal is cast in die casting machines 10, 46, and 48. During die casting, water vapor 12 is released from machines 10, 46, and 48. Machines 10, 46, and 48 utilize a water-soluble die release fluid and hydraulic equipment containing a water-insoluble hydraulic fluid. After casting, used hydraulic fluid and used die release fluid is carried through conduit 14 to catch basin 15. The fluid is thereafter transferred to filter 16 via conduit 17 through pump 36. The solids, which are entrapped in filter 16, are removed manually or via mechanical means. The resultant fluid from filter 16 is carried through conduit 18 to holding tank 20 where phase separation occurs between used hydraulic fluid and used die release fluid. After separation, used hydraulic fluid is carried through conduit 64 to waste tank 30 and used die release agent is carried through conduit 56 to holding tank 24. In holding tank 24, another phase separation occurs between remaining hydraulic fluid and the used die release fluid. After separation, used hydraulic fluid is carrier through conduit 42 to waste tank 30 and used die release agent is carried through conduit 58 to holding tank 26. In holding tank 26, another phase separation occurs between remaining hydraulic fluid and the used die release fluid. After separation, used die release fluid from holding tanks 20, 24, and 26 is combined with water from water tank 38 via conduit 60 and new die release fluid from tank 40 via conduit 62. The hydraulic fluid from holding tank 26 is transferred to waste tank 30 via conduit 44. This mixture is returned to machines 10, 46, and 48 via conduit 22 for die casting a second sample of the metal. A pump 27 is located along conduit 22. Any remaining die release agent is separated from the hydraulic fluid in waste tank 30 and is returned to filter 16 via conduit 28. The used hydraulic fluid remaining in waste tank 30 is transferred to waste tank 32 via conduit 54 where another phase separation occurred. The die release fluid is also returned to filter 16 via conduit 28 and the final used hydraulic fluid from waste tank 32 is carried to waste treatment via conduit 34.

The following examples are illustrative only and are not intended to limit the present invention.

F. Examples

Example 1

Comparison of Phase Separation Between Water-Soluble Die Release Fluid and Hydraulic Fluids Laboratory testing was performed on two different die release fluids and with various hydraulic fluids in an effort to demonstrate the effectiveness of water-insoluble hydraulic fluids in separating from die release fluids. A water-glycol hydraulic fluid was used in a side-by-side comparison with a water miscible, ester-based hydraulic fluid to illustrate the extent to which the water-glycol hydraulic fluid mixed with the die release fluid, as opposed to the water-insoluble hydraulic fluid, which did not mix with the die release fluid.

A sample of die release fluid, i.e., the Cast Rite® AMZ III reagent (Cross Chemical) was combined with water at an 80:1 volume/volume concentration (water:die release fluid). The hydraulic fluid utilized in the die casting was the Cosmolubric® B-220 FMA reagent, which is a non-water dilutable ester based fluid available from Houghton. The following provide the details regarding the experiment:

1. The Cast Rite® reagent (500 mL) was added to a separatory funnel (1 L).
2. The Cosmolubric® B-220 FMA reagent (25 mL) was then added to the separatory funnel to provide a solution containing 5% hydraulic fluid. This combination mimics a 5% tramp oil (e.g., containing contaminants) concentration in the die release fluid noted in industrial processes.
3. The separatory funnel was vigorously shaken for 5 minutes to mix the die release fluid and the hydraulic fluid. Immediately after shaking, it was visually noted that the hydraulic fluid immediately started to rise to the top and was substantially separated after 15 minutes. After sitting for 15 additional minutes undisturbed, the die release fluid and hydraulic fluid had visually separated in their entirety.

Side by side testing was performed to illustrate the ineffectiveness of a water-soluble hydraulic fluid to separate from the water-soluble die release fluid. Specifically, comparison experiments were performed using the non-water-dilutable, ester based Cosmolubric® B-230 hydraulic fluid (Houghton) and the water-glycol based HoughtoSafe 620 hydraulic fluid (Houghton). The testing was also performed with a different die release fluid, i.e., Safety Lube 2006AL-3 reagent (ChemTrend) at a concentration of 80:1 volume/volume (water:product). The following provide the details regarding the experiment:

1. The Safety Lube® reagent (400 mL—ChemTrend) was added to two beakers.
2. The Cosmolubric® B-230 reagent (20 mL) was added to one beaker from step 1 and the HoughtoSafe® 620 reagent (20 mL) was added to the second beaker from step 1 each beaker containing 5% of the hydraulic fluid.
3. The two beakers were then independently mixed for 5 seconds with stirring rods.

It was visually noted that the Cosmolubric® B-230 reagent floated to the top of the mixture instantly after being combined with the Safety Lube® reagent. In addition, the Cosmolubric® B-230 reagent remained layered on top of the Safety Lube® reagent even after mixing. In comparison, the HoughtoSafe® 620 reagent visually partially mixed with the Safety Lube reagent after combination. In fact, the HoughtoSafe® 620 reagent and Safety Lube reagent were completely combined after mixing with the stirring rod for 5 seconds.

These data illustrate that water-insoluble hydraulic fluids readily separate from water-soluble die release fluids. This is completely inapposite to the miscibility observed between water-soluble hydraulic fluids with water-soluble die release fluids.

Example 2

Comparison of Phase Separation Between Compositions Containing Water-Soluble Die Release Fluid and an Antimicrobial and Hydraulic Fluids Experiments are performed to determine the impact of the addition of an antimicrobial on the separation of the hydraulic fluid and die release fluids discussed in Example 1.

A sample of die release fluid, i.e., the Cast Rite® AMZ III reagent (Cross Chemical) is combined with water-soluble antimicrobial Busan® 1060 (Buckman Laboratories, Inc.) and water at an 80:1 volume/volume concentration (water:die release fluid). The hydraulic fluid is the Cosmolubric® B-220 FMA reagent, which is a non-water dilutable ester based fluid available from Houghton. The following provide the details regarding the experiment:

1. The Cast Rite® reagent (500 mL) and less than 1% of the water-soluble antimicrobial are added to a separatory funnel (1 L).
2. The Cosmolubric® B-220 FMA reagent (25 mL) is then added to the separatory funnel, wherein the separatory funnel will contain 5% of the hydraulic fluid.
3. The separatory funnel is vigorously shaken for 5 minutes to mix the die release fluid and the hydraulic fluid. Immediately after shaking, it is anticipated to visually note that the hydraulic fluid will immediately start to rise to the top and will be substantially separated after 15 minutes. It is further anticipated that, after sitting for 15 additional minutes undisturbed, the die release fluid/antimicrobial layer and hydraulic fluid layer will be visually separated in their entirety.

Side by side testing is performed to illustrate the ineffectiveness of a water-soluble hydraulic fluid to separate from the water-soluble die release fluid. Specifically, comparison experiments are performed using a water-insoluble, ester based fluid (Houghton's Cosmolubric® B-230 reagent) and water-soluble antimicrobial Busan® 1060 (Buckman Laboratories, Inc.) and a water-glycol based hydraulic fluid (Houghton's HoughtoSafe® 620 reagent). The testing is performed with a different die release fluid, i.e., ChemTrend's Safety Lube® 2006AL-3 reagent at a concentration of 80:1 volume/volume (water:die release fluid). The following provides the details regarding the experiment:

4. The Safety Lube® reagent (400 mL) is added to each of two beakers.
5. The Cosmolubric® B-230 reagent (20 mL) and less than 1% of the water-soluble antimicrobial reagent is added to one beaker and HoughtoSafe® 620 reagent (20 mL) and less than 1% of the water-soluble antimicrobial reagent is added to the second beaker.
6. The two beakers are then independently mixed with stirring rods for 5 seconds.

It is anticipated that one will visually note that the Cosmolubric® B-230 reagent/antimicrobial composition will float to the top of the mixture instantly after being combined with the Safety Lube® reagent. In addition, it is anticipated that the Cosmolubric® B-230 reagent will remain layered on top of the Safety Lube® reagent even after mixing. In comparison, it is anticipated that the HoughtoSafe® 620 reagent will partially mix with the Safety Lube® reagent after its combination.

It is expected that these data will illustrate that antimicrobials do not influence the separation of water-insoluble hydraulic from water-soluble die release fluids.

Example 3

A Process for Die Casting Metals Using Water-Insoluble Hydraulic Fluids

Factory experiments were performed to determine if a water-insoluble die release fluid could be recycled in a process whereby a water-insoluble hydraulic fluid is utilized. Specifically, Cast Rite® AMZ III reagent (Cross Chemical) was utilized as the water-soluble die release fluid and Cosmolubric® B-220 FMA reagent (Houghton) was utilized as the hydraulic fluid instead of a water glycol hydraulic fluid.

The experiment was performed using a 1,500 ton die casting machine which produces truck frame rails using an aluminum alloy. See, FIG. 5 which is a schematic of the set-up utilized for these experiments. One die cast machine in the system was isolated from the other die cast machines so that the die release fluid and tramp hydraulic fluid could be collected. Tanks 1, 2, and 3 were 1,000 gallon tanks juxtaposed on different elevations so the tanks can cascade into each other, i.e., tank 1 flows tank 2 and tank 2 flows to tank 3. Primary fluid separation takes place in tank 1. The bulk of the hydraulic fluid will float to the top of tank 1 and tank 1 feeds into tank 2 from the bottom of tank 1 so hydraulic fluid that contaminates tank 2 is minimal. Tank 2 feeds into tank 3 from the bottom of tank 2 so hydraulic fluid that contaminates tank 3 is minimal. Flow meters were installed throughout the system so that the total flow of die release fluid could be monitored and the number of cycles could be determined.

The experiment was initially initiated with tank 3 being completed filled with the Cast Rite® die release fluid at a concentration of 80:1 (water:product) with reverse osmosis (RO) water. Pump 2 pumped the die release fluid to the isolated die cast machine where the die release fluid and tramp hydraulic fluid were then captured in a sump. The fluid from the sump was then pumped via pump 1 through a 20 micron bag filter into tank 1. As Tanks 1 and 2 were filled, tank 3 was constantly topped off with premixed die release fluid. This continued until all three tanks were at capacity (3,000 gallons of total fluid). Once the experiment had commenced, no fluids were added or removed to/from the system, except for the addition of a small amount of water (~100 gallons) to help overcome the evaporation losses from the die casting process. None of the separated and Cosmolubric® B-220 FMA hydraulic fluid was removed the system and it continued to increase in volume in tank 1 as the trial progressed.

Once the experiment had begun, the system was "operated to failure", i.e., the system was operated to cast parts until either (i) the parts no longer had good quality or (ii) until the die release fluid was no longer usable. Neither of these two failure modes were reached since all of the available metal available for casting was utilized first. At this end point, it was determined that the die release fluid had been cycled a surprising thirteen times (13×) throughout the system. In fact, it was observed that, unexpectedly, the parts prepared from the die casting machine at the end of the experiment had the same quality as the parts which had been prepared at the beginning of the experiment. All 13 parts were usable for production purposes.

This experiment illustrated that the water-insoluble hydraulic fluid easily separated from the water-soluble die release fluid. This result is contrary to what has been observed for the water glycol based hydraulic fluids which completely mix with water-soluble die release fluids.

Example 4

Figure 5:
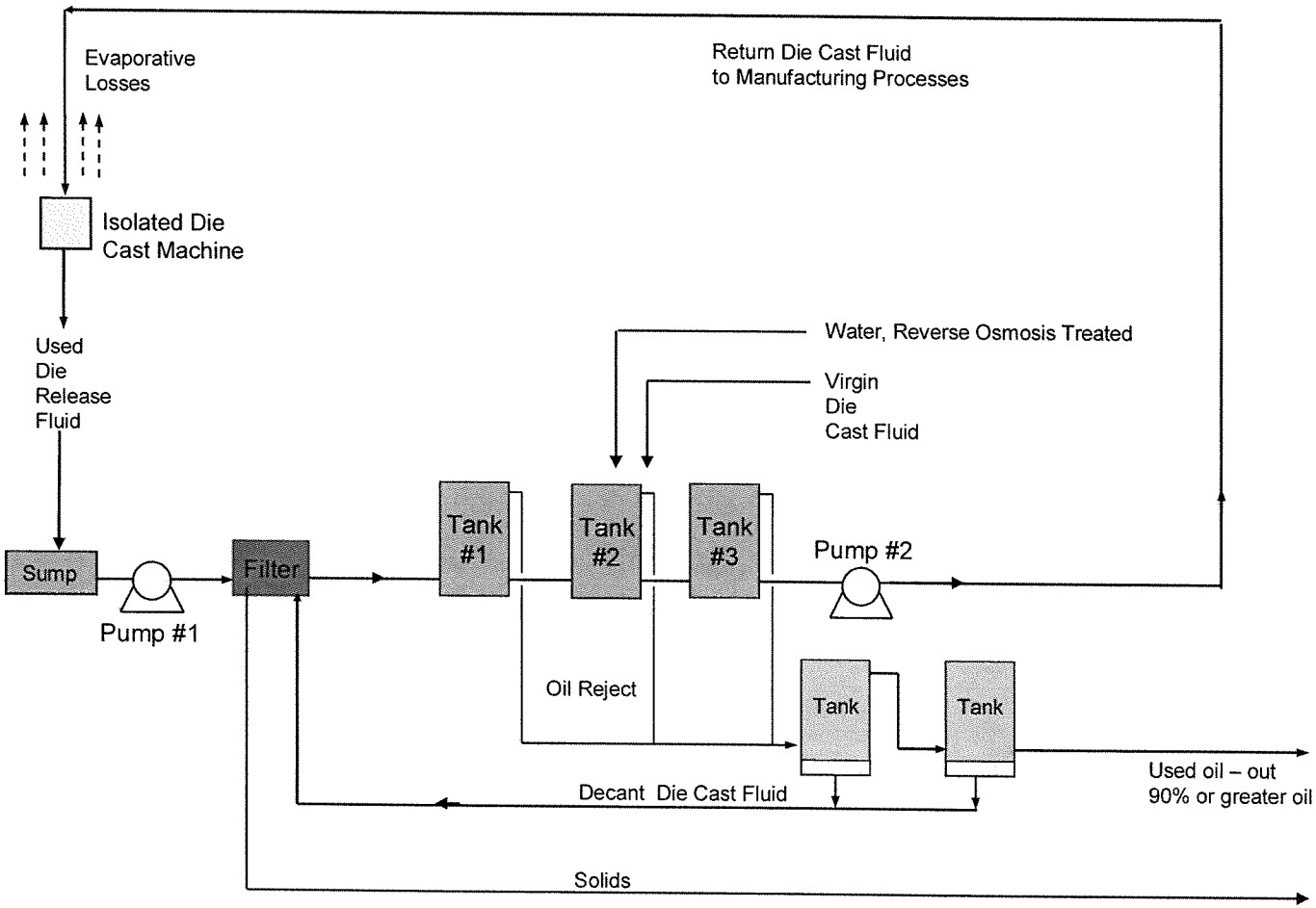
FIG. 5 is a schematic of the automotive process line utilized in Example 3.

A Process for Die Casting Metals Using Water-Insoluble Hydraulic Fluids Containing an Antimicrobial A factory experiment will be performed to determine if the incorporation of an antimicrobial into the hydraulic fluid discussed in Example 3 will prevent microbial build up in the system of FIG. 5. This experiment will be performed identically to the experiment of Example 3, with the exception that 20 ppm of the Busan® 1060 reagent (Buckman Laboratories Inc.) water-soluble antimicrobial will be added to the Cosmolubric® B-220 FMA reagent.

It is anticipated that minimal to no microbial growth will be noted in the die casting system. It is also anticipated that the parts prepared from the die casting machine at the end of the experiment will have the same quality as parts prepared at the beginning of the experiment. All 13 parts should be usable for production purposes.

All publications cited in this specification are incorporated herein by reference. While the invention has been described with reference to particular embodiments, it will be appreciated that modifications can be made without departing from the spirit of the invention. Such modifications are intended to fall within the scope of the appended claims.

What is claimed is:

1. A process for die casting a metal, said process comprising:

(a) die casting said metal using a die coated with a water-soluble die release fluid and hydraulic equipment comprising a water-insoluble hydraulic fluid, wherein said water-insoluble hydraulic fluid comprises one or more of the components selected from canola oil, corn oil, cottonseed oil, sunflower oil, peanut oil, soybean oil, coconut oil, Jojoba oil, castor oil, palm oil, palm kernel oil, a synthetic fatty acid ester, phosphate ester, and a polyol ester, or a blend of more than one of the said components; wherein said die release fluid and said hydraulic fluid are immiscible;

(b) collecting from the hydraulic equipment the die release fluid admixed with the hydraulic fluid;

(c) subjecting the admixed die release fluid and hydraulic fluid to phase separation;

(d) returning the phase separated die release fluid into the die casting process without further separation; and (e) repeating the steps of (a) through (d) multiple times without reducing the effectiveness and efficiency of die release fluid or adversely impacting the condition of the die cast metal.

2. The process according to claim 1, wherein said die release fluid and said hydraulic fluid do not emulsify when combined.

3. The process according to claim 1, wherein said hydraulic fluid is biodegradable.

4. The process according to claim 1, wherein said die release fluid comprises water, surfactants, antimicrobials, petroleum oil, esters, silicones, waxes, or a combination thereof.

5. The process according to claim 1, wherein one or both of said die release fluid and hydraulic fluid are recyclable.

6. The process according to claim 1, wherein said die release fluid further comprises an antimicrobial.

7. The process according to claim 1, wherein said metal comprises aluminum, zinc, magnesium, copper, lead, or tin.

8. The process according to claim 1, wherein said die release fluid and hydraulic fluid are at least about 99% immiscible.

9. The process according to claim 8, wherein said die release fluid and hydraulic fluid are 100% immiscible.

10. The process according to claim 1, further comprising:

applying said water-soluble die release fluid to a die in a die casting machine; and die casting said metal using said hydraulic equipment comprising a water-insoluble hydraulic fluid.

11. The process according to claim 10, further comprising:

collecting used die release fluid and used hydraulic fluid from a catch basin;

separating said used die release fluid and said used hydraulic fluid; and die casting a second sample of said metal using said used die release fluid.

12. The process according to claim 11, wherein unused die release fluid is added to said used die release fluid for die casting the second sample.

13. The process according to claim 11, further comprising:

rectifying said used hydraulic fluid with water or disposing of the product after die casting the second sample of metal;

wherein the amount of said water in the rectifying step is 10-fold less than the amount of water utilized to treat waste generated from a process for die casting a metal comprising aluminum using a water-insoluble die release fluid.

14. The process according to claim 10, further comprising:

collecting the used die release fluid and used hydraulic fluid from a catch basin; and isolating said used die release fluid and said used hydraulic fluid.

15. The process according to claim 1, wherein said water-insoluble hydraulic fluid comprises canola oil, corn oil, cottonseed oil, sunflower oil, peanut oil, soybean oil, coconut oil, Jojoba oil, castor oil, palm oil, and palm kernel oil, or a blend of one or more of these oils.

16. The process according to claim 1, wherein said water-insoluble hydraulic fluid contains:

(a) one or more synthetic fatty acid ester, or (b) a phosphate ester, or (c) a blend of animal or vegetable oil with a synthetic fatty acid ester or a polyol ester.

* * * * *